US006462302B1

(12) United States Patent
Grow

(10) Patent No.: US 6,462,302 B1
(45) Date of Patent: Oct. 8, 2002

(54) RIFLED WEAPON BARREL ENGRAVER AND SCANNER

(75) Inventor: Ivan Grow, Kansas City, KS (US)

(73) Assignee: Bar Code Bullet Industries, LLC, Kansas City, KS (US)

( * ) Notice: Subject to any disclaimer, the term of this patent is extended or adjusted under 35 U.S.C. 154(b) by 0 days.

(21) Appl. No.: 09/826,760

(22) Filed: Apr. 5, 2001

(51) Int. Cl.[7] ..... B23K 26/00

(52) U.S. Cl. ..... 219/121.68; 219/121.69; 42/1.01

(58) Field of Search ..... 219/121.6, 121.68, 219/121.69, 121.82, 121.85; 42/1.01

(56) References Cited

U.S. PATENT DOCUMENTS 3,701,097 A 10/1972 Wolff
3,800,074 A * 3/1974 Fletcher et al. ..... 178/6
4,035,942 A 7/1977 Wiczer
4,175,346 A * 11/1979 Zemsky ..... 42/78
5,379,106 A * 1/1995 Baldur ..... 356/375
5,758,446 A * 6/1998 Atchison ..... 42/78
6,176,434 B1 * 1/2001 Baldur ..... 235/494
6,256,121 B1 * 7/2001 Lizotte et al. ..... 359/15
6,257,149 B1 * 7/2001 Cesaroni ..... 102/515
6,327,032 B1 * 12/2001 Lajeunesse et al. ..... 356/390

FOREIGN PATENT DOCUMENTS

FR 2683064 A1 * 4/1993 ..... 42/1.01

* cited by examiner

*Primary Examiner*—Samuel M. Heinrich
(74) *Attorney, Agent, or Firm*—Chase Law Firm, L.C.

(57) ABSTRACT

A computer-controlled laser etching probe etches a firearm-identifying indicia such as a barcode encoded serial number into the bore of a firearm. Owner registration data coupled with the serial number is stored in a central database. A computer-controlled scanner reads the barcode from a bullet fired from an etched firearm for comparison with registration data in the central database, thereby identifying the registered owner of the firearm from which the bullet was fired.

9 Claims, 7 Drawing Sheets

RIFLED WEAPON BARREL ENGRAVER AND SCANNER

BACKGROUND OF THE INVENTION

This invention relates to a method and system for marking the inner surface of the barrel of a firearm with an identifying indicia for transfer to a bullet passing therethrough, reading the indicia from the bullet and identifying the firearm and, in particular, to the modification of the inner surface of a firearm barrel using a laser for the purpose of producing one or more areas of permanent grooves, which impart firearm data onto rounds passing through the barrel in contact with the inner surface of the barrel to form a barcode-like pattern which may be read by a barcode scanner and matched to the firearm.

In order to link a bullet with the firearm that fired it, it is known in the art to examine a bullet, usually comparatively with another bullet, each with small, irregular microscopically viewable markings imparted during firing to determine a similarity between such markings whereby to support a conclusion that both bullets were fired from the same firearm.

In order to facilitate ballistic identification procedures with only the fired bullet available, various systems have been proposed in which bullets are marked by placing a channeled ring containing a number of dye bars in a groove in the barrel, which impart markings to the bullets which pass over them. The dye bars are assembled in different combinations according to a preset code which corresponds to the firearm's serial number. Other systems have been proposed in which the identifying markings are an integral part of the barrel and bore surface so that they cannot be removed without damaging or disabling the firearm. Among the problems with such systems is that the identifying marking elements must be incorporated during manufacture of the firearm. Thus, identification of bullets fired by guns currently in use must be done the traditional way, which requires not only the bullet, but the gun to fire another bullet for comparison with the bullet in question.

SUMMARY OF THE INVENTION

It is therefore, the primary object of the present invention to provide a method and system for the placing identifying markings on the bore surface of a barrel of a firearm, transferring the markings to a bullet fired therefrom, scanning the markings on the bullet and identifying the registered owner of the firearm from which the bullet was fired.

Another important object of the present invention is to provide a method and system for etching the bore of a firearm barrel as aforesaid, which uses a laser probe inserted into the barrel.

Yet another important object of the present invention is to provide a method and system for etching the bore of a firearm barrel as aforesaid, with a barcode or other identifying indicia.

Still another important object of the present invention is to provide a method and system for etching the bore of a firearm barrel as aforesaid, which may be adapted for different firearm models.

Another important object of the present invention is to provide a method and system for etching the bore of a firearm barrel with an identifying indicia as aforesaid, and entering registration data into an associated computer indicative of the owner of the firearm corresponding to the identifying indicia.

Yet another important object of the present invention is to provide a method and system for etching the bore of a firearm barrel as aforesaid and transferring registration data entered into an associated computer to a central database for subsequent comparison with scanned data and retrieval.

Still another important object of the present invention is to provide a method and system for scanning a bullet marked with an identifying indicia from an etched firearm as aforesaid, which translates the indicia into a serial number or other corresponding alpha-numeric digits.

Another important object of the present invention is to provide a method and system for scanning a bullet marked with an identifying indicia from an etched firearm as aforesaid, and requesting registration data corresponding to the indicia from a central database for display and identification of the registered owner of the etched firearm.

These and other objects of the invention are achieved by a computer controlled laser system adapted to etch the bore of a firearm using an etching probe inserted into the firearm barrel. Firearm identifying data, such as a serial number, are etched in the bore of the firearm in the form of a barcode or other identifying indicia. Registration data corresponding to the owner of the firearm and the serial number or other firearm identifying data are entered into a computer and transferred to a central database. A bullet fired from an etched firearm is marked with the etched barcode. A computer controlled scanning system reads the barcode and translates it into a serial number or other firearm identifying data for comparison with serial number stored in the central database.

Other objects and advantages of the invention will become apparent from the following description taken in connection with the accompanying drawings, wherein is set forth by way of illustration and example, an embodiment of this invention.

DESCRIPTION OF THE PREFERRED EMBODIMENTS

Figure 1:
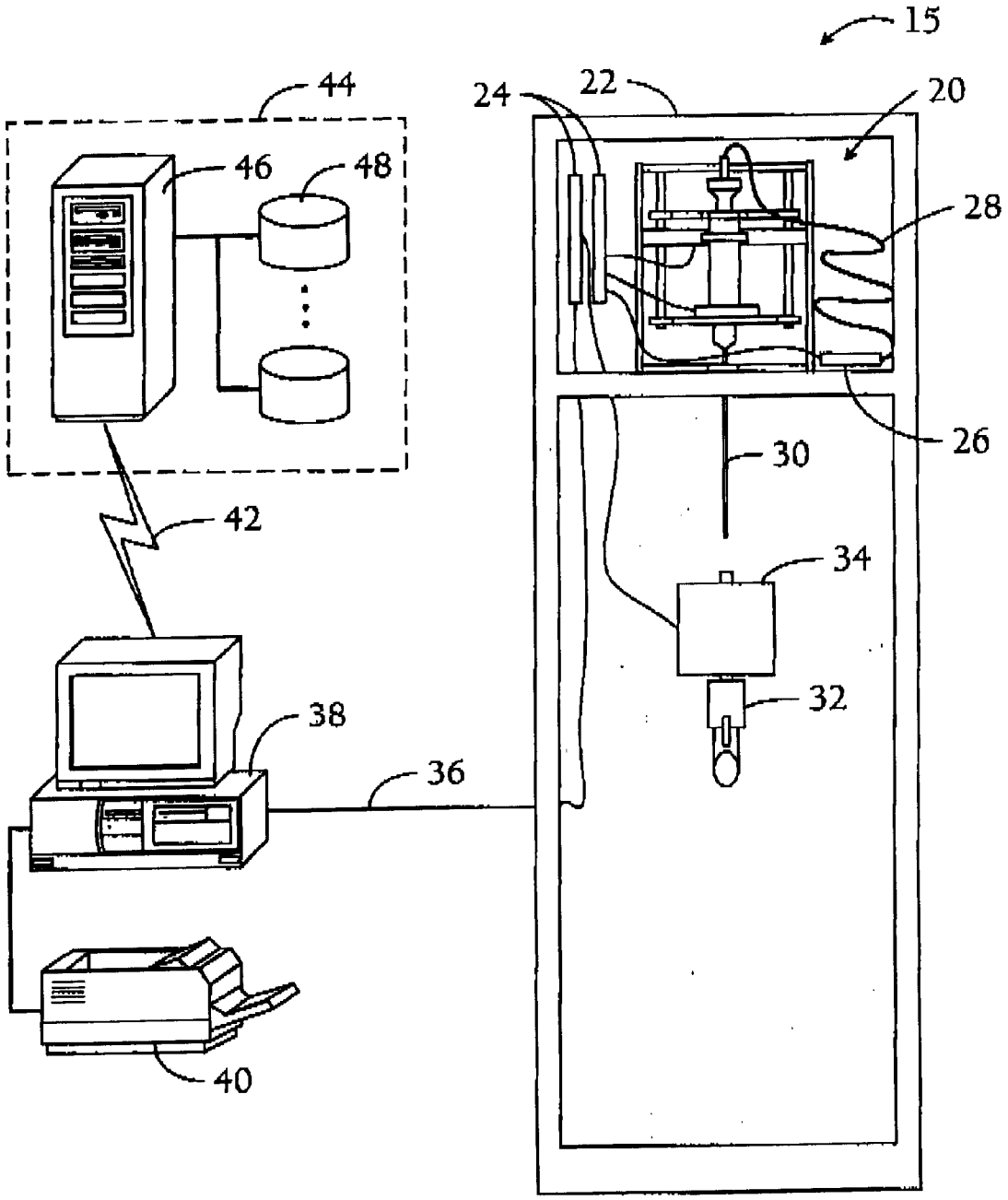
FIG. 1 is diagrammatic view of the barrel-marking system of the present invention.

Turning more particularly to the drawings, FIG. 1 illustrates a firearm barrel-marking system of the present invention including a barrel etching assembly 20 shown mounted in cabinet 22. One or more electronic controller boards 24 control the output of laser tube 26 which is connected through optical fiber 28 to etching assembly 20 and the positioning of laser tube 30 to etch the bore of gun 32 held in clamp 34. It is to be understood that a mirror system may be used in place of optical fiber 28 to direct the output of laser tube 26 to etching assembly 20.

Input and control data is transferred to boards 24 over parallel line 36 from computer 38. Computer 38 may be a personal computer having a modem and an attached printer 40. Serial number and registration data for gun 32 may be entered into computer 38 which are transferred over line 36 to control boards 24 to be used for input and control parameters. Registration data may be entered into computer 38 transferred from computer 38 through communications link 42 to computer system 44. Computer system 44 may consist of a server 46 and one or more databases 48 to store the firearms registration data. Computer system 44 may be controlled and operated by a federal law enforcement agency such as the FBI for registration and identification of a firearm 32.

Figure 2:
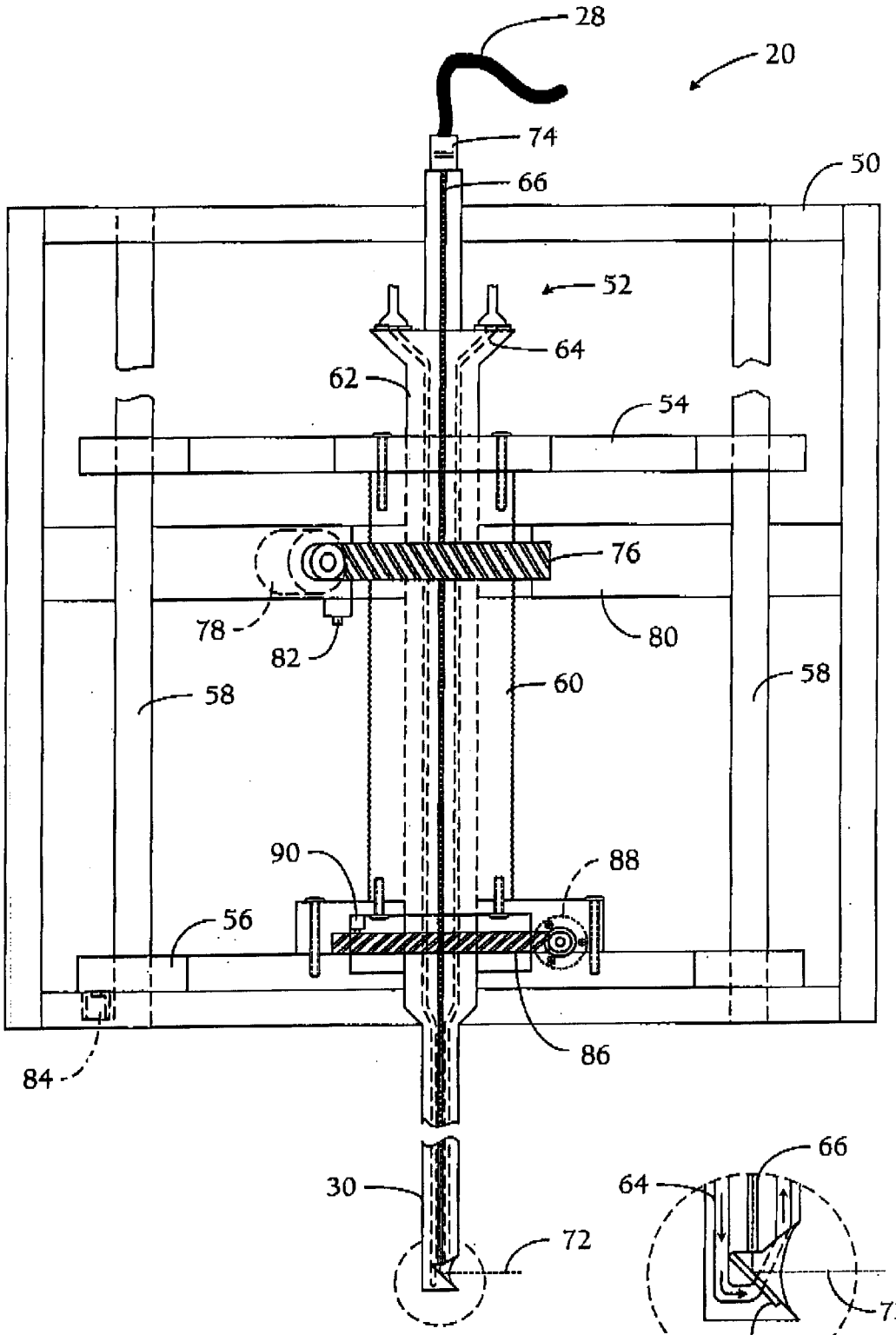
FIG. 2 is an front elevational view of a barrel-etching assembly.
Figure 2A:
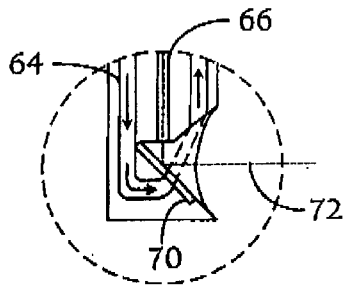
Figure 3:
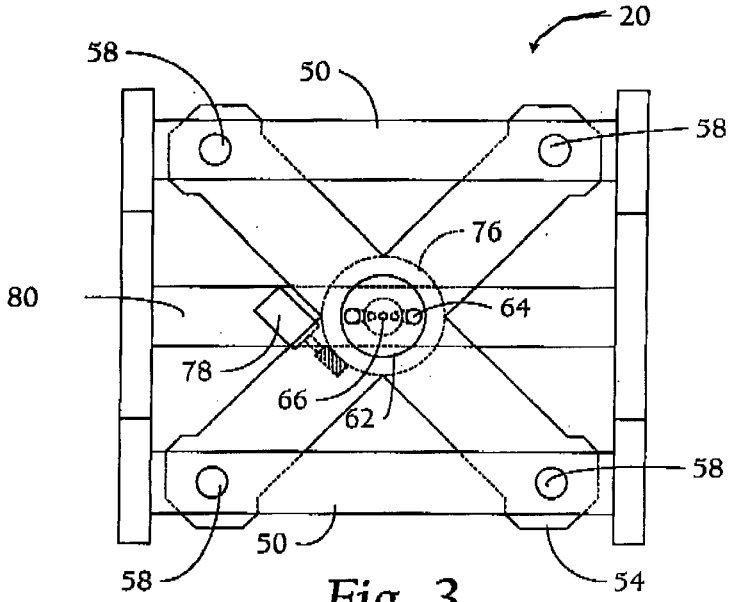
FIG. 3 is a top plan view of the barrel-etching assembly shown in FIG. 2.

Referring to FIGS. 2, 2*a* and 3, laser etching assembly 20 includes frame 50 which supports laser tube assembly 52. Laser tube assembly 52 is secured to upper 54 and lower 56 support cross members which slidably engage guide rods 58.

Laser tube assembly 52 includes a threaded outer cylinder 60 which extends between and is secured to upper 54 and lower 56 support cross members. A reflector positioning tube 62 is rotatably secured within cylinder 60. Reflector positioning tube 62 includes coolant tubing 64, laser tube 66, probe 30 and reflector 70. Laser light 72 is injected into laser tube assembly 52 from fiber optic line 28 through connector 74 into tube 66.

An upper vertical alignment gear 76, which engages the threads of cylinder 60 is controlled by stepper motor 78. Gear 78 is housed in center frame member 80. Limit switches 82 and 84 limit the vertical displacement of laser tube assembly 52 between the center frame 80 and lower of member frame 50. Stepper motor 78 precisely controls the placement of probe 30. Limit switch 84 is also used to indicate when probe 30 is in the starting or default position.

Rotation of laser tube assembly 52 is accomplished by a lower worm gear 86 secured to laser tube assembly 52 and engaged by step motor 88. A limit switch 90 may be used to limit rotation of laser tube assembly 52 to prevent damage to optical fiber 28 and to indicate when laser tube assembly 52 is rotated to the starting or default position.

Figure 4:
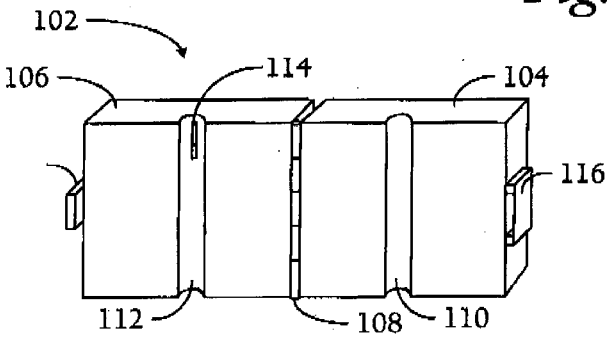
FIG. 4 is a side view of a barrel clamping apparatus for proper positioning of a barrel to be marked, shown in an open position.
Figure 5:
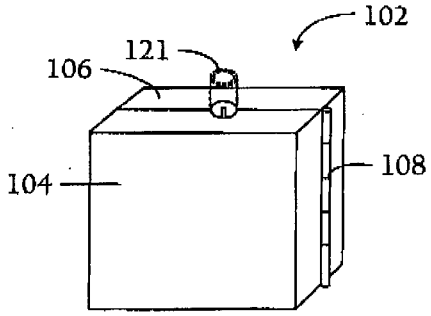
FIG. 5 is a side view of the barrel clamping apparatus of FIG. 4 shown in a closed position.
Figure 7:
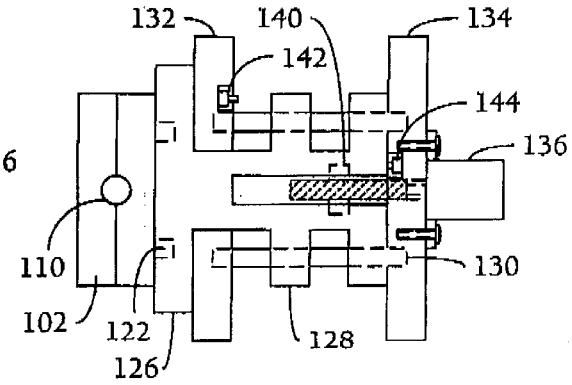
FIG. 7 is a top cutaway view of the clamp centering apparatus shown in FIG. 6.

Referring to FIGS. 4 and 7, a centering clamp assembly 100 is shown which includes a barrel clamp 102 with front 104 and rear 106 clamping members which are pivotally secured together by hinge 108. Clamping members 104 and 106 include channels 110 and 112 respectively, which are shaped to accept a gun barrel placed in clamping assembly 102. An orienting key channel 114 for receiving a gun sight is located toward the upper end of channel 112. When barrel clamp 102 is closed, channels 110 and 112 are in axial alignment and form a barrel-holding and aligning cylinder. Barrel clamp 102 may be locked in the closed position with latches 116 and 118 to secure a gun barrel 121 in place for etching.

Figure 6:
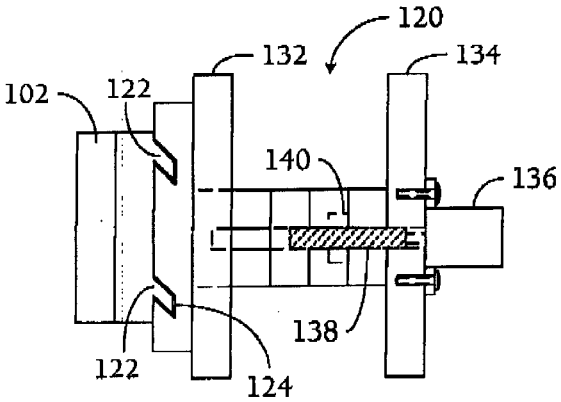
FIG. 6 is a side cutaway view of the clamp centering apparatus.

Referring to FIGS. 6 and 7, alignment of clamping assembly 100 may be adjusted by alignment assembly 120 to axially align the bore of barrel 121 with etching probe 30 (See FIGS. 1 and 2). Mounting pegs 122 extending from the back of barrel clamp 102 are seated in apertures 124 on face plate 126 and are held in place by gravity. Other methods of holding barrel clamp 102 to face plate 126 may be used such as bolts or other fasteners. The barrel clamp 102 may be quickly changed and sized for specific weapons which may require different of barrel clamps if different gun models are to be etched. In a manufacturing facility, where the same or similar gun is made with the same size barrel and bore, the barrel clamp 102 may be more permanently installed.

Because different guns have different bores, alignment of barrel clamp 102 may require adjustment to bring barrel 121 into axial alignment with etching probe 30. Face plate 126 of alignment assembly 120 is secured to a clamp adjustment slide 128 which may be adjusted along generally parallel rods 130 which are secured between end plates 132 and 134. Stepper motor 136 drives screw 138 which interfaces with threaded insert 140 secured to clamp adjustment slide 128. Limit switches 142 and 144 cut power to stepper motor 136 when either is engaged to limit movement of clamp adjustment slide 128.

Figure 8:
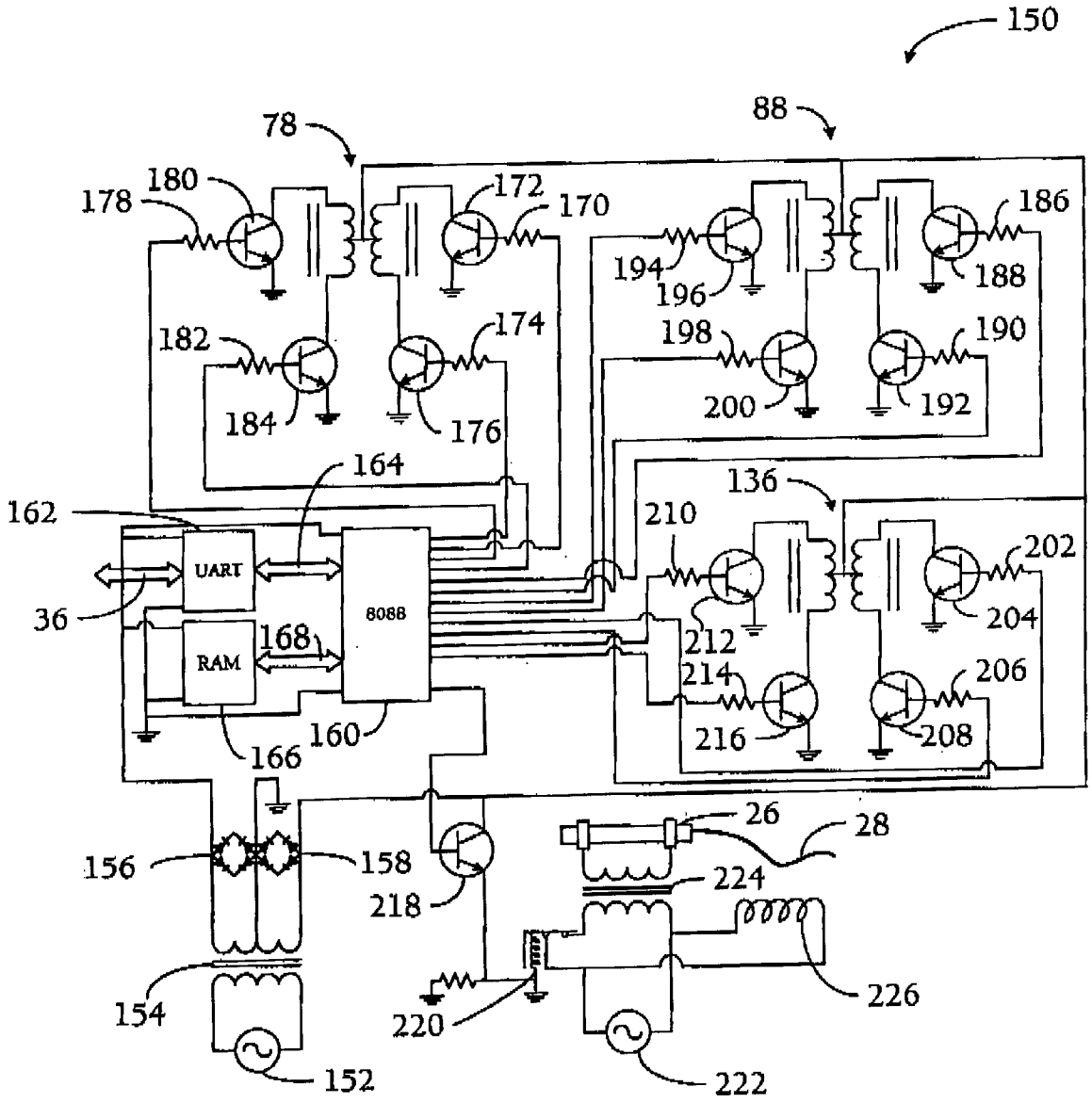
FIG. 8 is a schematic of the microprocessor controlled engraver circuit.

Referring to FIG. 8, a laser etching controller circuit is generally indicated by reference number 150. Power supply 152 includes a center tapped transformer 154 which converts 120 volts AC to +5 volts DC and +12 volts DC using bridge rectifiers 156 and 158 respectively.

Microprocessor 160 controls stepper motors 78, 88 and 136. In the preferred embodiment, a 16-bit Intel 8088 microprocessor may be used to control the stepper motors. Because of the relatively limited processing load on the microprocessor, processors with relatively limited processing capabilities and speed may be used. However microprocessors with greater capabilities may be used.

In the preferred embodiment, stepper motor 78, 88 and 136 are generally unipolar permanent magnet motors with center tapped windings, as shown in FIG. 8, with an angular resolution of 0.9 to 0.45 degrees or 400 steps per resolution to 800 steps per revolution respectively. Higher resolution motors may be used to encode more data into the bore of a gun.

Setup and control data is transferred from PC 38 over parallel line 36 to UART 162 which is transferred to microprocessor 160 over line 164. Setup data for a specific gun model is stored in memory 166 in a look up table which is retrieved by microprocessor 160 over address line 168 in response to setup and control data transferred from PC 38.

Stepper motor 78 may require up to 2 amps of current to move laser tube assembly 52, thus, PNP transistors 172, 176, 180 and 184 may be power darlington transistors with a current gain of over 1,000 such as an SK3180 transistor. Using a 470 ohm resistor for bias resistors 170, 174, 178 and 182 permits a ten miliamp current to flow to the respective transistor 172, 176, 180 and 184 to allow the transistor to switch a few amps of current through the stepper motor 178 winding as controlled by microprocessor 160 on output lines 0–3. Because each winding of stepper motors 88 and 136 draw less than 500 milliamps, darlington transistors 188, 192, 196, 200, 204, 208, 212 and 216 and associated resistors 186, 190, 194, 198, 202, 206, 210 and 214 may be incorporated into an array such as the ULN200x family of darlington arrays from Allegro Microsystems which is also available as the DJ200x family of arrays from National Semiconductor. The UDN2547D Quadpower Driver from Allegro Microsystems will handle all four windings of common stepper motors such as stepper motors 88 and 136 for example.

Microprocessor 160 also controls laser tube 26 through transistor switch 218 which energize relay 220 to switch power from source 222 to power transformer 224 which provides three KVAC to laser tube 26, and to incandescent heater 26. Laser output from laser tube 226 is injected into fiber optic line 28.

Referring to FIGS. 1–11 and 15, to etch the bore of hand gun 32 for example, hand gun 32 is placed into clamp assembly 102 with the gun sight 250 on barrel 252 aligned with channel 114. Then, clamp assembly 102 is closed and latched around gun barrel 252.

The model number, make and serial number of gun 32 is entered into computer 38 and this data is transferred over line 36 to UART 162 and then to microprocessor 164. The registration data is stored in RAM 350. Microprocessor 160 reads the gun parameters from memory 166 and correlates the data and the barcode geometry 352. Based on the set up parameters, if necessary, the location of clamp assembly 102 is adjusted by commanding stepper motor 136 to rotate in either direction to bring barrel bore 254 into axial alignment with laser etching probe 30. After the hardware is calculated 354, safety switches are checked 356 to ensure that the cabinet 22 door is closed for example. If the cabinet 22 door is not closed the engraver is reset 358 and processing returns to the start.

If the safety switches are set 356, the engraver is moved into position 360. Vertical positioner worm gear 76 powered by stepper motor 78 moves laser control tube assembly 52 into the start position under supervision of microprocessor 160 until closure of switch 84. Additionally, laser tube 62 is rotated by stepper motor 88 again under supervision of microprocessor 160 until closure of switch 90. Etching probe 30 is now in place in the bore 254 of barrel 252.

Microprocessor 160 retrieves data concerning firearm configuration, if necessary and specific barcode instructions from RAM 66 or through UART 162 from PC 38. Once laser etching probe 30 is in position, microprocessor 160 sends a signal to transistor 218 to close relay switch 220 and activate resistive heating element 226 used in laser tube 26 to activate the laser 362. Microprocessor 160 also commands a coolant pump (not shown) to begin circulating coolant through passages 64 in order to maintain stability of laser reflector 70 while in contact with the laser beam 72.

After laser tube 26 has reached operational temperatures, a one micron 30-watt carbon dioxide laser is output from laser tube 26 into fiber optic line 28, which is injected into laser tube 66, reflected from laser reflector 70 and transmitted as beam 72 into the bore 254 of gun 32. Laser tube 26 is switched on and off while laser etching probe 30 is rotated lowered rotated again in the opposite direction and raised continuously forming grooved bar coding dyes 256 in the bore 254 of barrel 252. The laser is activated 362 and microprocessor 160 controls the stepper motors 364 to form a groove in bore 254. At the end of each groove or barcode strip 256 the laser is deactivated 366 and microprocessor 160 checks to determine if the barcode is complete 368. If the barcode is not complete, the engraver is positioned 360 to the beginning of the next stripe and the process repeats.

The grooves of barcode 256 may be from 10 to 50 microns in depth. The serial number of 32 is encoded into the space and bars of various width of barcode 256. The number of characters represented in a linear inch of a barcode is called the barcode density, which depends on the barcode symbology. For example, using Code 39, 9.4 characters can fit in one inch. The resolution of a barcode is dependent on the narrowest element of a barcode. Because of the relatively small circumferential area available in bore 254, barcode 256 is compressed or scanned from the standard barcodes known in the art. For example, interleaved 2 of 5 which is capable of encoding up to 30 digits may be scaled from 17.8 characters per inch to 17.8 characters per 0.125 inches or 142.2 characters per inch. Other codes could be used such as Code 128 which can encode the entire 128 ASCII character set.

By way of example, a 38-caliber head gun has a bore circumference of approximately 1.2 inches. Using an 800 steps/revolution stepper motor, the angular distance is 0.45 degrees/step or approximately 0.0015 inches/step. For a barcode 0.125 inch wide and using interleaved 2 of 5 scaled by eight, 17 characters can be encoded. There are approximately 83 steps in 0.125 inch. Using a stepper motor with an angular resolution of 3200 step/revolution, 71 characters can be encoded a 0.125 inch barcode using interleaved 2 of 5 with a step spacing of 0.000375 inch.

Once barcode 252 is completed 368, microprocessor 160 commands stepper motor 78 to withdraw the etching probe from the barrel 370 by raising laser tube assembly 52 until switch 82 is engaged. Firearm 32 may now be removed from clamp assembly 102. Information regarding the serial number make and model of gun 32 may now be transferred from computer 38 to law enforcement system 44 over communication link 42 to be stored in databases 48 connected to computer 46. It should be understood that data from more than one gun may be transmitted together to computer system 44.

Figure 9:
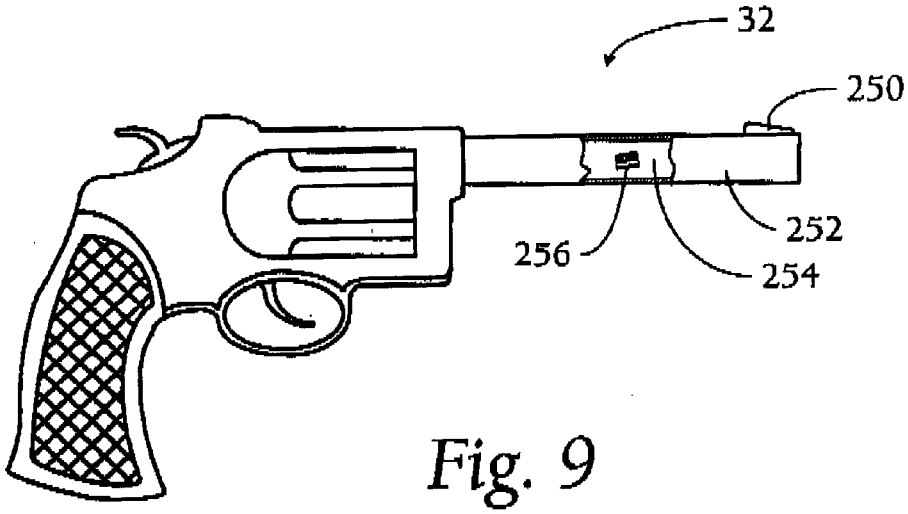
FIG. 9 is a diagrammatic illustration of a gun with the barrel cut away to show the barcode markings on the bore of the barrel.
Figure 10:
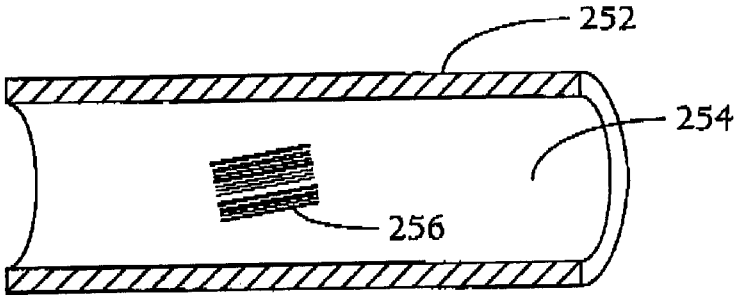
FIG. 10 is a diagramatic illustration of barcode markings on the bore of the firearm barrel of FIG. 4.
Figure 11:
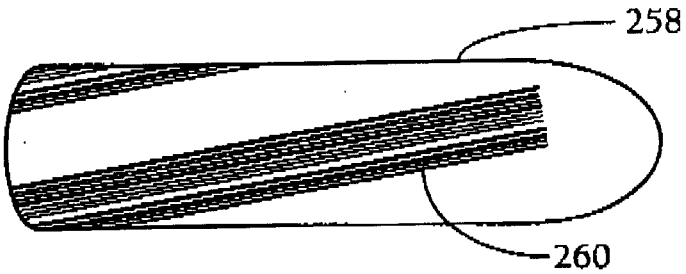
FIG. 11 is diagramatic illustration of barcode markings on a bullet.
Figure 12:
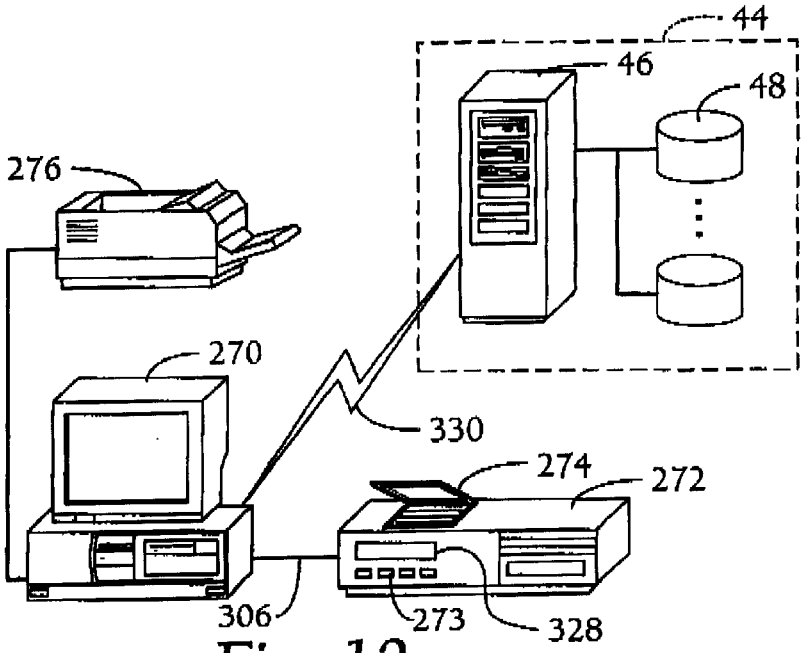
FIG. 12 is diagramatic illustration of the barcode bullet scanning system for scanning and identifying a marked bullet.
Figure 13:
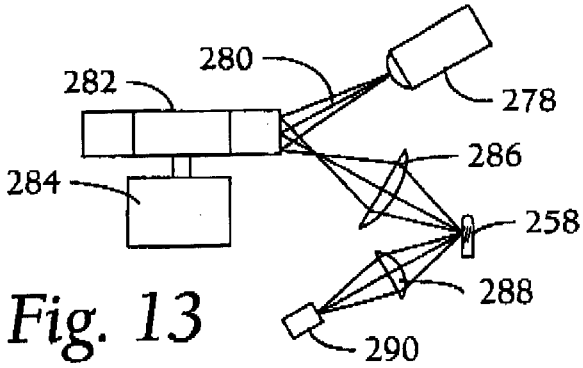
FIG. 13 is a diagrammatic illustration of a scanner for reading the barcode on a marked bullet.

Referring to FIGS. 9–11, barcode 256 in bore 254 is etched parallel to the rifling in bore 254. A bullet 258 fired from gun 32 marked with barcode 256 will have the barcode transferred to the bullet as indicated by 260. Thus, any bullet 258 fired from gun 32 may be traced by barcode 260 without access to gun 32.

Referring to FIGS. 11–14 and 16, to read barcode 260 on bullet 258, bullet 258 is placed in scan bed 274 in barcode bullet scanner 272, which is linked to computer 270.

Microprocessor 312 activates the scanner and detector current 380. Laser diode 278 outputs a 5 milliwatt laser 280, which is reflected from mirror assembly 282 rotated by motor 284 through beam focusing lens 286 and reflected from bullet 258 through light condensing lens 288 onto phototransistor 290. The diameter of the beam incident on bullet 258 should be at least one half the spacing of the individual bars of barcode 260, which may be approximately 20 to 50 microns.

Figure 14:
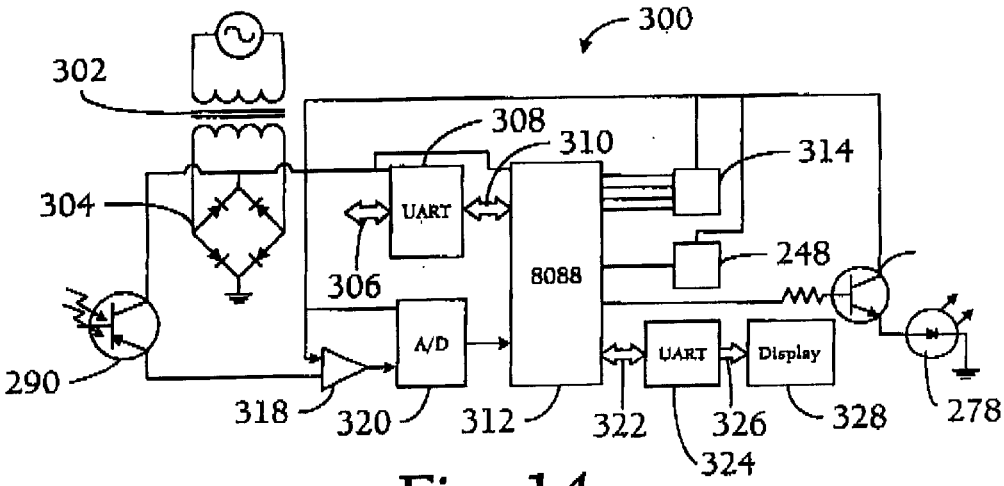
FIG. 14 is a schematic of the scanner circuit.
Figure 15:
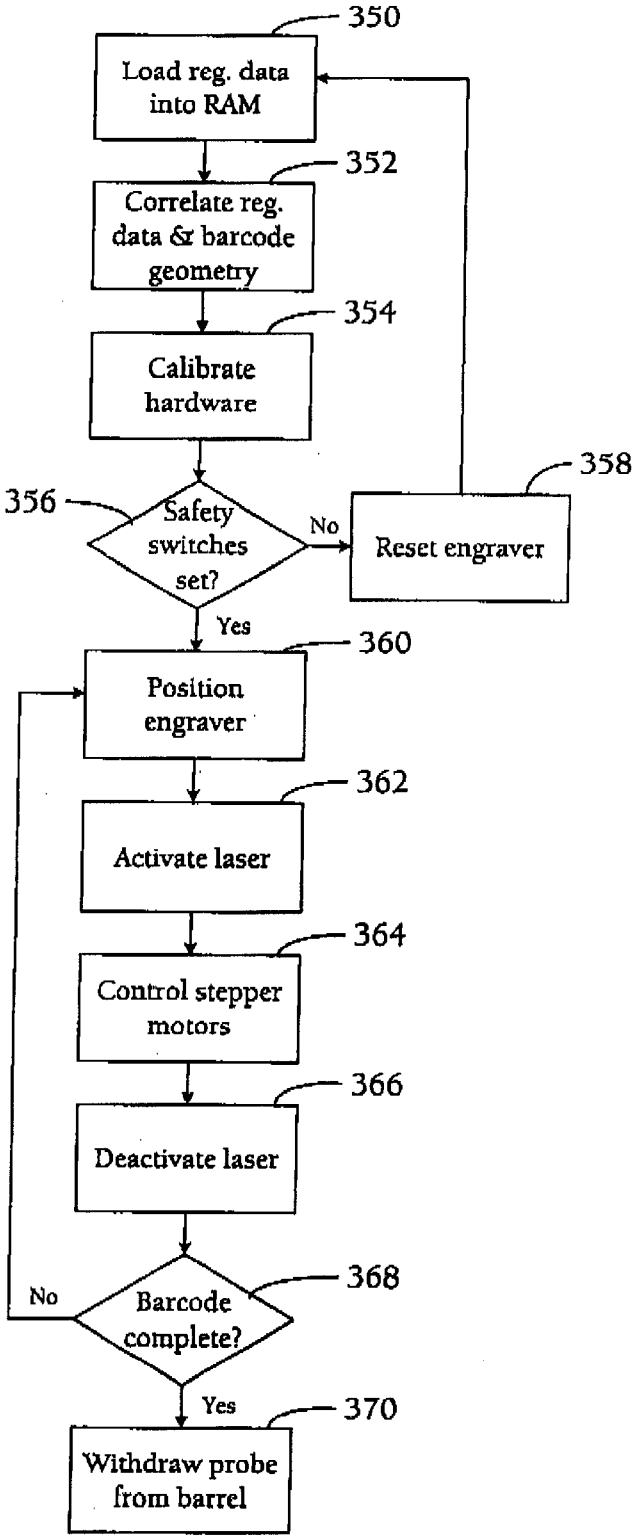
FIG. 15 is a functional block diagram of the engraver control software.
Figure 16:
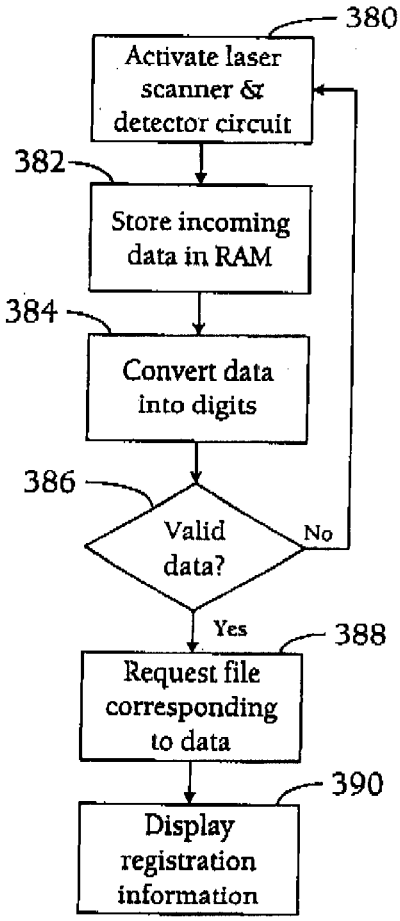
FIG. 16 is a functional block diagram of the scanner control software.

Scanner circuit 300 as shown in FIG. 14, includes transformer 302 and full wave rectifier 304 which provides 5 volts DC for circuit 300. UART 308 provides an interface between 8088 microprocessor 312, and computer 70 over lines 306 and 310. Microprocessor 312 controls scanner bed stepper motor 314 and mirror assembly motor 248. Upon command from control buttons 273 on the front of scanner 272 or from computer 270, microprocessor 312 activates transistor 316 to enable laser diode 278. Bullet 258 is rotated in scanner bed 274 so that the entire width of barcode 260 may be scanned. Light reflected from barcode 260 on bullet 258 is received by phototransistor 290. The signal from phototransistor 290 is input to amp 318 and fed through A/D converter 320 and stored in RAM 382. Microprocessor 312 converts the encoded signal into digits 384, by a method known in the art. If valid data is not detected 386, bullet 258 is scanned again. Scanning may be attempted two or more times before scanning is abandoned and an error message displayed.

If valid data is detected, the data is output on line 322 to UART 324 and transferred on line 326 to display 328 on the front panel of scanner console 272. The digits is also transferred via UART 308 over line 306 to computer 270, which are assembled into a serial number. The serial number may now be transmitted over communication link 330 to law enforcement computer system 44, which includes computer 46 and databases 48 and the file corresponding to the data is requested 388. The serial number is matched with data in databases 48 and the associated registration information is transmitted back to computer 270 and displayed 390. This information may then be printed on laser printer 276. Accordingly, the bullet may be traced to the firing gun and the registered owner of the gun.

Having thus described the invention, what is claimed as new and desired to be secured by Letters Patent is as follows:

1. A method for identifying a firearm from which a bullet is fired, said method comprising the steps of:

entering identifying data into a computer system to identify said firearm, storing said identifying data, encoding said identifying data, etching said encoded data into said bore of said firearm, transferring said encoded data from said bore to a surface of a bullet upon firing said bullet from said firearm, scanning said encoded data on said bullet, decoding said encoded data scanned from said bullet to provide decoded data, and comparing said decoded data with said stored identifying data whereby to identify said firearm from which said bullet was fired.

2. The method as claimed in claim 1 further comprising the steps of:

entering registration data into said computer system indicative of an owner of said firearm;

coupling said identifying data with said registration data, and identifying said owner of said firearm from said decoded data.

3. The method as claimed in claim 1 wherein said step (d) includes inserting a laser etching probe into said bore, and emitting a laser energy from said probe in response to said encoded data.

4. An apparatus for etching the bore of a firearm with an identifying indicia for subsequent identification of the firearm from a bullet fired therefrom, said apparatus comprising:

processing means for storing registration data corresponding to an owner of said firearm and identifying data indicative of said firearm and comparing input data therewith, means for encoding said identifying data, means for etching said encoded identifying data in said bore of said firearm, whereby a bullet fired from said firearm will have markings corresponding to said encoded data transferred to a surface of said bullet from said etched bore, and means for reading said markings and inputting said read data to said processing means for comparison with identifying data stored therein, whereby to identify the firearm from which the bullet was fired.

5. The apparatus as claimed in claim 4 wherein said processing means includes means for transferring said registration data and said identifying data to a central database.

6. The apparatus as claimed in claim 4 wherein said etching means comprises:

a laser etching assembly having a frame, a laser etching tube, and a laser etching tube support member, said laser etching tube rotatably secured to said laser etching tube support member, said laser etching tube support member slideably secured to said frame, said laser etching tube having a laser probe for directing a laser beam from a laser tube at the surface of said bore, a first stepper motor for controlling the linear movement of said laser etching tube, a second stepper motor for controlling rotation of said laser etching tube, and a microprocessor for controlling said stepper motors and laser beam output from said laser tube whereby said processor directs movement of said probe in said bore of said firearm in a predetermined pattern in coordination with laser output of said laser tube to etch said encoded data on the surface of said bore.

7. The apparatus as claimed in claim 6 wherein said etching means further comprises a firearm clamping means for securing said firearm in axial alignment with said laser probe.

8. The apparatus as claimed in claim 6 wherein said etching means further comprises a firearm clamping assembly for securing said firearm in axial alignment with said laser probe and having an alignment assembly and a barrel clamp releasably mounted to said alignment assembly, said alignment assembly having a clamp adjustment slide coupled to a third stepper motor to adjust the linear position of said barrel clamp in response to control signals from said microprocessor.

9. An apparatus for etching the bore of a firearm with an identifying indicia for subsequent identification of the firearm from a bullet fired therefrom, said apparatus comprising:

a laser etching assembly having a frame, a laser etching tube, and a laser etching tube support member, said laser etching tube rotatably secured to said laser etching tube support member, said laser etching tube support member slideably secured to said frame, said laser etching tube having a laser probe for directing a laser beam from a laser tube at the surface of said bore, means for controlling the linear and rotational movement of said laser etching tube, a microprocessor for directing said controlling means and said laser beam output from said laser tube whereby said processor directs movement of said probe in said bore of said firearm in a predetermined pattern in coordination with said laser output of said laser tube to etch said encoded data on the surface of said bore.

* * * * *